US007578400B1

(12) United States Patent
Hartman, Sr.

(10) Patent No.: US 7,578,400 B1
(45) Date of Patent: Aug. 25, 2009

(54) CHAIR STORAGE RACK

(76) Inventor: Frank C. Hartman, Sr., 301 Evergreen Rd., Barrington, NJ (US) 08007

( * ) Notice: Subject to any disclaimer, the term of this patent is extended or adjusted under 35 U.S.C. 154(b) by 0 days.

(21) Appl. No.: 12/229,558

(22) Filed: Aug. 25, 2008

(51) Int. Cl.
*A47F 7/00* (2006.01)

(52) U.S. Cl. ..... 211/27; 211/182

(58) Field of Classification Search ..... 211/206, 211/204, 27, 182, 193, 13.1; 312/257.1, 312/265.1; 206/326; 135/121
See application file for complete search history.

(56) References Cited

U.S. PATENT DOCUMENTS 525,162 A * 8/1894 Schwartz, Jr. ..... 211/190
795,152 A * 7/1905 Montgomery ..... 211/27
858,733 A * 7/1907 Lindley ..... 211/27
896,856 A * 8/1908 Luppert ..... 122/504
905,163 A * 12/1908 Finney et al. ..... 211/27
972,447 A * 10/1910 Harper ..... 211/27
1,047,053 A * 12/1912 Holland ..... 211/206
1,912,864 A * 6/1933 Stannard ..... 211/27
1,966,751 A * 7/1934 Brefeld ..... 211/85.16
3,375,960 A * 4/1968 Stevens et al. ..... 224/42.11
3,429,449 A * 2/1969 Schroer et al. ..... 211/27
3,462,166 A * 8/1969 Fuhrmann ..... 280/33.997
4,895,381 A * 1/1990 Farlow ..... 280/33.997
5,351,843 A * 10/1994 Wichman et al. ..... 211/195
5,520,293 A * 5/1996 Hartley ..... 211/182
5,678,973 A * 10/1997 Cox ..... 414/341
7,070,056 B2 * 7/2006 Powders ..... 211/13.1
7,185,899 B2 * 3/2007 Thiede et al. ..... 280/47.35
7,270,339 B2 * 9/2007 Feick ..... 280/79.3

* cited by examiner

*Primary Examiner*—Jennifer E. Novosad
(74) *Attorney, Agent, or Firm*—Stuart M. Goldstein

(57) ABSTRACT

A chair storage rack has a base member to be placed on the ground and leg members which are vertically upstanding from the base. Dual support arms extend perpendicularly from the leg members. Beach or similar chairs are hung from the support arms, such that the chairs hang substantially parallel to the leg members. A support frame extends rearwardly of the support arms and perpendicular to the leg members, providing a storage space for the placement of beach umbrellas and other outdoor accessories. The chair storage rack is lightweight for easy transport and placement in any desired location.

2 Claims, 2 Drawing Sheets

CHAIR STORAGE RACK

BACKGROUND OF THE INVENTION

Most common beach chairs comprise framing which is partially exposed and partially covered by seat and back support material. While such chairs are quite adaptable and very comfortable for use as recreational seating, this awkward, framed configuration makes them difficult to easily and effectively store. What user of beach chairs has not experienced the frustration of attempting to hang these chairs on wall hooks or stack them neatly for storage? Ultimately, such chairs are positioned perilously on hooks, haphazardly leaned against a wall, or simply piled in a corner. Surprisingly, there currently is no means to easily, efficiently, neatly, and safely store beach chairs.

SUMMARY OF THE INVENTION

It is thus the object of the present invention to overcome the limitations and disadvantages of prior beach chair storage means and methods.

It is an object of the present invention to provide a beach chair storage rack which allows beach and chairs of similar configurations, to be quickly, simply, and easily positioned for storage.

It is another object of the present invention to provide a beach chair storage rack on which a plurality of chairs can be hung in an orderly, neat fashion.

It is still another object of the present invention to provide a beach chair storage rack which allows the safe and secure storage of chairs above the ground, to promote the cleanliness of the stored chairs.

It is a further object of the present invention to provide a beach chair storage rack which offers an efficient, compact chair storage system, opening space in areas where otherwise stacked chairs would occupy.

It is another object of the present invention to provide a beach chair storage rack which allows easy and safe removal of chairs for use.

It is still another object of the present invention to provide a beach chair storage rack which is lightweight and portable, for easy transport and placement in any desired location.

It is a further object of the present invention to provide a beach chair storage rack which provides additional storage space for umbrellas or other outdoor accessories.

It is another object of the present invention to provide a beach chair storage rack which can be used immediately, without the need for installation on a wall, ceiling, or other areas where installation tools may be required.

These and other objectives are accomplished by the present invention, a chair storage rack which comprises a base member to be placed on the ground and leg members which are vertically upstanding from the base. Dual support arms extend perpendicularly from the leg members. Beach or similar chairs are hung from the support arms, such that the chairs hang substantially parallel to the leg members. A support frame extends rearwardly of the support arms and perpendicular to the leg members, providing a storage space for the placement of beach umbrellas and other outdoor accessories. The chair storage rack is lightweight for easy transport and placement in any desired location.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
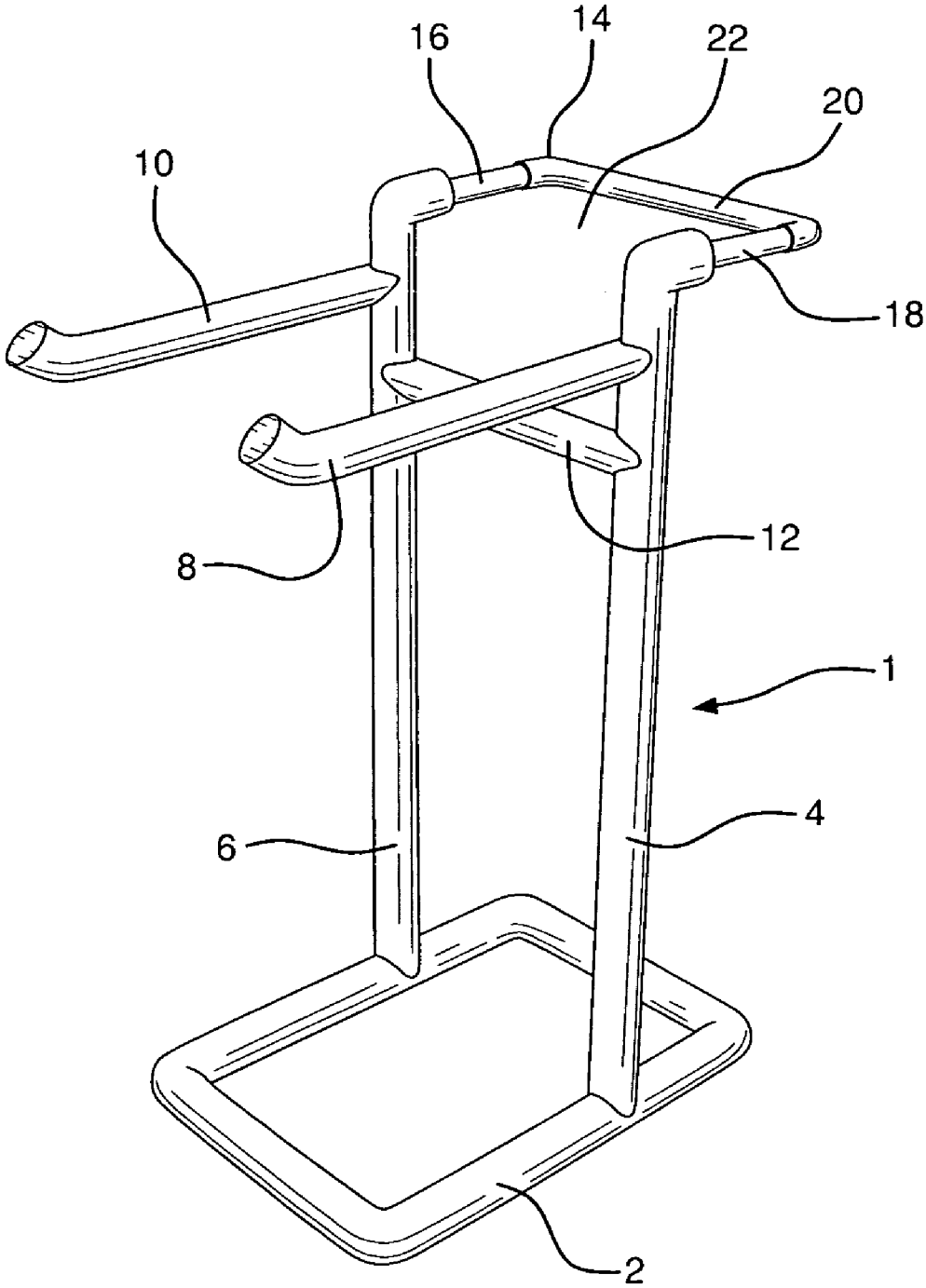
FIG. 1 is an isometric view of the chair storage rack of the present invention.

Chair storage rack 1 comprises base member 2, which as shown in the drawings, is rectangular in configuration. Base member 2 is not to be considered restricted to a rectangular shape, but can be of any desired shape. It has been found, however, that, for the purpose of providing stability when chairs are hung on storage rack 1, that a rectangle is the optimum configuration, as described further hereinafter.

Leg members 4 and 6 secured at their lower ends to base member 2, extend vertically upward from the base. Leg members 4 and 6 are positioned aft of the transverse centerline of base member 2. Cross-brace 12 extends between leg members 4 and 6. Support arms 8 and 10 extend forward of and substantially perpendicular out from leg members 4 and 6. Support arms 8 and 10 are curved slightly upward at their outboard ends.

Support frame 14, comprising lateral supports 16 and 18 and rear support 20, extends rearward and substantially perpendicular out from leg members 4 and 6. Support frame 14 is located above support arms 8 and 10. Storage space 22 is formed within support frame 14, between the support frame and cross-brace 12.

Figure 2:
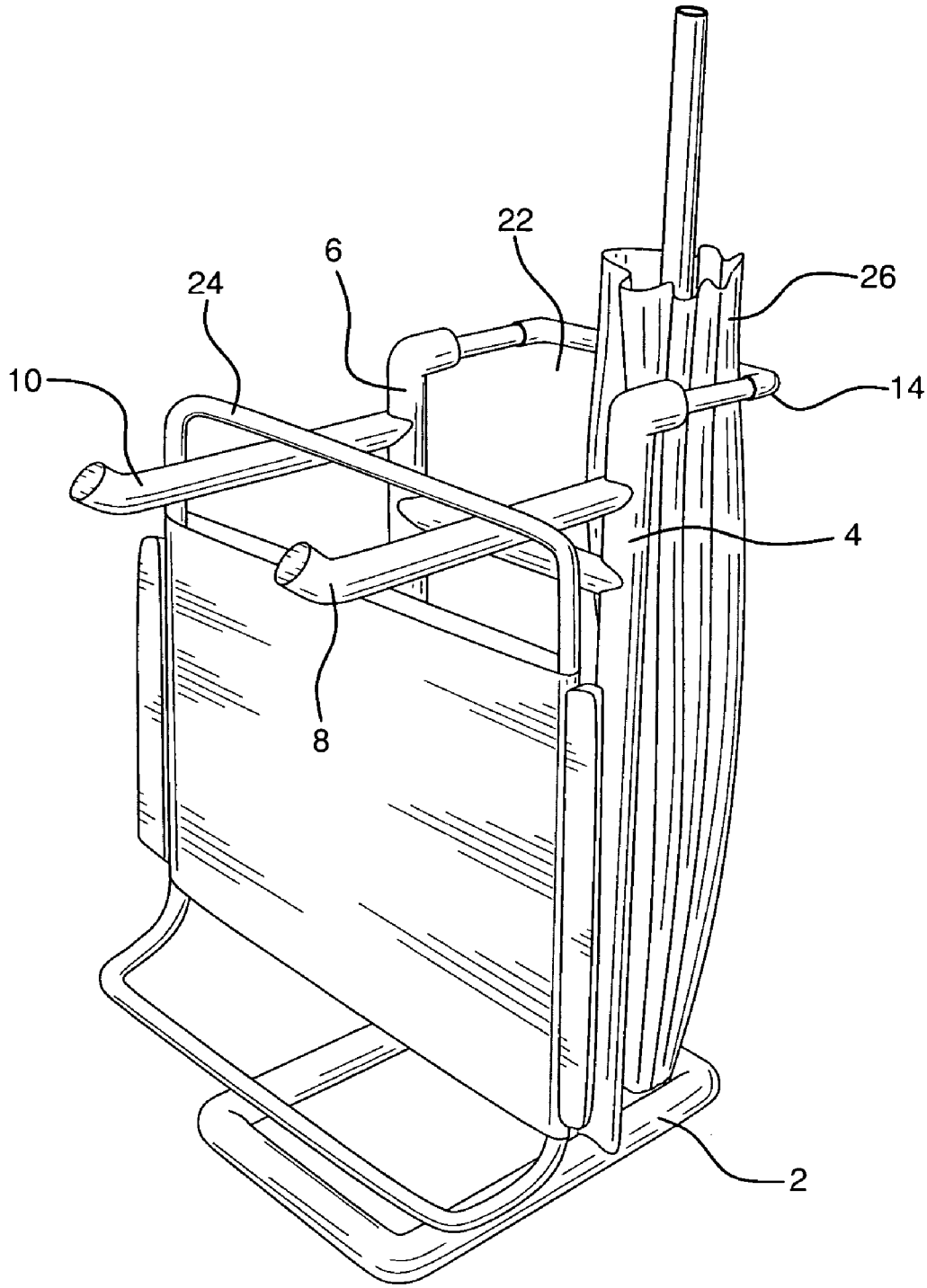
FIG. 2 is an isometric view of the chair storage rack of the present invention, exemplifying its use with a beach chair and a beach umbrella.

FIG. 2 shows chair storage rack 1 in use. Beach chair 24 is easily placed on support arms 8 and 10, allowing the chair to hang above the ground surface, parallel to leg members 4 and 6. The offset positioning of leg members 4 and 6 in relation to the transverse centerline of base member 2, provides the necessary stability to storage rack 1 to prevent it from tipping when chairs are placed on support arms 8 and 10 for storage. The curved outer ends of support arms 8 and 10 assist in maintaining one or more chairs 24 thereon.

Umbrella 26 and other elongated outdoor accessories such as support poles, sporting equipment, etc., can be stored within storage space 22.

Storage rack 1 of the present invention is thus configured for quick and simple placement of one or more beach or similar chairs. In storage, the chairs are positioned in a neat and orderly fashion, above the ground for easy and safe removal when needed. It is contemplated that storage rack 1 will be constructed of PVC piping or similar lightweight material to promote its portability. Storage rack 1 can be integrally molded or it can be manufactured with individual components which can be assembled to form the completed rack.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A chair storage rack for hanging chairs and for storing elongated outdoor accessories comprising:

a base member having a front end and a rearward end configured to be placed directly on the ground;

leg members vertically upstanding from the base member, said leg members being located aft of the transverse centerline of the base member and forward of the rearward end of the base member;

chair support means cantilevered outward and extending forward of and substantially perpendicularly out from the leg members for the placement and hanging of said chairs on the chair support means, the chair support means being located at a height above the base member so as to ensure that the hanging chairs are positioned and remain stored substantially parallel to the leg members and above the base member; and a support frame positioned above the chair support means and cantilevered rearward of and substantially perpendicularly out from the leg members, said frame forming a closed loop extending outwardly from the leg members and circumscribing a storage space behind the chair support means for the placement and storage of said elongated outdoor accessories.

2. The chair and storage rack as in claim 1 wherein the chair support means comprises dual support arms.

* * * * *